US007488165B2

(12) United States Patent
Ogasawara et al.

(10) Patent No.: US 7,488,165 B2
(45) Date of Patent: Feb. 10, 2009

(54) COMPRESSOR HAVING BACK PRESSURE VANE CONTROLLED FOR IMPROVING OIL DISTRIBUTION

(75) Inventors: Hirotsugu Ogasawara, Ota (JP); Takahiro Nishikawa, Gunma-ken (JP); Akihiro Suda, Ota (JP); Masayuki Hara, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 11/808,842

(22) Filed: Jun. 13, 2007

(65) Prior Publication Data

US 2008/0031764 A1 Feb. 7, 2008

Related U.S. Application Data

(62) Division of application No. 11/219,915, filed on Sep. 7, 2005, now Pat. No. 7,381,040.

(30) Foreign Application Priority Data

Sep. 30, 2004 (JP) ..... 2004-286707
Sep. 30, 2004 (JP) ..... 2004-286716

(51) Int. Cl.
*F04C 18/00* (2006.01)
*F03C 4/00* (2006.01)

(52) U.S. Cl. ..... 418/232; 418/88; 418/219

(58) Field of Classification Search ..... 418/63, 418/88, 57, 216, 219, 230–232; 417/366
See application file for complete search history.

(56) References Cited

U.S. PATENT DOCUMENTS

| | | | | |
|---|---|---|---|---|
| 3,317,123 | A * | 5/1967 | Funke | 418/88 |
| 3,434,656 | A * | 3/1969 | Bellmer | 418/94 |
| 4,437,823 | A * | 3/1984 | Tigane | 418/219 |
| 5,169,299 | A * | 12/1992 | Gannaway | 418/94 |
| 7,114,930 | B2 * | 10/2006 | Ogasawara et al. | 418/232 |
| 2003/0138340 | A1 * | 7/2003 | Kim et al. | 418/219 |
| 2005/0152792 | A1 * | 7/2005 | Ogasawara et al. | 417/410.3 |

FOREIGN PATENT DOCUMENTS

| | | | |
|---|---|---|---|
| EP | 754273 | B1 * | 1/1998 |
| JP | 5-00172 | | 4/2003 |
| JP | 2003-532008 | | 10/2003 |

* cited by examiner

*Primary Examiner*—Theresa Trieu
(74) *Attorney, Agent, or Firm*—Kratz, Quintos & Hanson, LLP

(57) ABSTRACT

Previous compressors have employed compressors to compress and circulate refrigerant through a circuit, and have been unable to combine the differing advantages of rotary compressors, scroll compressors and screw compressors. The present invention combines these advantages, as well as inhibiting refrigerant leakage and improving overall performance, by particularly fixing the position of the compression member of the compression element relative to the driving element. The driving element is stored in a sealed container of the compressor. The compression element includes a cylinder having suction and discharge ports and a compression member which compresses a fluid (refrigerant) sucked from the suction port to discharge the fluid via the discharge port; and a vane partitioning the compression space in the cylinder into a low pressure chamber and a high pressure chamber.

1 Claim, 10 Drawing Sheets

COMPRESSOR HAVING BACK PRESSURE VANE CONTROLLED FOR IMPROVING OIL DISTRIBUTION

This applications is a Divisional of prior application Ser. No. 11/219,915 filed on Sep. 7, 2005 now U.S. Pat. No. 7,381,040, the contents being incorporated herein by reference.

BACKGROUND OF THE INVENTION

The present invention relates to a compressor which compresses fluids such as refrigerants or air and discharges the compressed fluids.

For example, a refrigerator has heretofore employed a system in which a compressor is used to compress a refrigerant and the compressed refrigerant is circulated through a circuit. As the systems of the compressor in this case, there are a rotary compressor called a rotary type compressor (e.g., see Japanese Patent Application Laid-Open No. 5-99172 (Patent Document 1)), a scroll compressor, and a screw compressor.

The rotary compressor has advantages that a structure is relatively simple and production costs are low, but there is a problem of increases in vibration and torque fluctuation. In the case of the scroll compressor and the screw compressor, there is a problem of high costs caused by bad workability while torque fluctuation is small.

Thus, there has been developed a system which disposes a swash plate as a rotary compression member in a cylinder and partitions compression spaces constituted below and above the swash plate by a vane to compress fluids (e.g., PCT No. 2003-532008 (Patent Document 2)). According to the compressor of such system, there is an advantage of constituting a compressor which is relatively simple in structure and small in vibration.

However, in the case of the structure of the Patent Document 2, since a high pressure chamber and a low pressure chamber are adjacent to each other below and above the compression member (swash plate) in the entire region of the cylinder, a difference between high and low pressures is enlarged, and refrigerant leakage causes a problem of efficiency deterioration Especially in a case where one surface of the compression member is disposed on a driving element side, the refrigerant in the compression space easily leaks between a rotary shaft and a bearing of the rotary shaft, and a performance of the compressor has been degraded.

Moreover, even in the compressor having the structure described in Patent Document 2 described above, an oil reservoir is formed in a lower part of a sealed container in the same manner as in the conventional compressor of Patent Document 1 described above. Since oil is supplied from the oil reservoir to the compression element by an oil pump, there has occurred a problem that it becomes difficult to supply the oil by the oil pump, and the supplied oil is insufficient in a case where the compression element is disposed in a position distant from the oil reservoir, such as a position above the driving element.

SUMMARY OF THE INVENTION

The present invention has been made to solve the aforementioned conventional technical problems, and an object thereof is to inhibit refrigerant leakage and improve a performance of a compressor.

Another object of the present invention is to supply oil smoothly to a sliding portion or the like of a compression element in a compressor in which the compression element is disposed above a driving element.

A first aspect of the present invention is directed to a compressor comprising a driving element stored in a sealed container, and a compression element driven by a rotary shaft of the driving element, the compression element comprising a cylinder in which a compression space is constituted; a suction port and a discharge port which communicate with the compression space in the cylinder; a compression member whose one surface crossing an axial direction of the rotary shaft is inclined continuously between a top dead center and a bottom dead center and which is rotatably disposed in the cylinder and which compresses a fluid sucked from the suction port to discharge the fluid from the discharge port; and a vane which is disposed between the suction port and the discharge port to abut on one surface of the compression member and which partitions the compression space in the cylinder into a low pressure chamber and a high pressure chamber, wherein one surface of the compression member is disposed on a side opposite to the driving element.

A second aspect of the present invention is directed to the above compressor, wherein the compression element is disposed above the driving element.

A third aspect of the present invention is directed to the above compressor, further comprising an oil pump for supplying oil to the compression element from an oil reservoir in a bottom part of the sealed container, wherein the fluid is discharged from the discharge port into the sealed container, and a back pressure of the vane is set to a value which is higher than that of a pressure of the fluid sucked into the suction port and which is lower than that of a pressure in the sealed container.

A fourth aspect of the present invention is directed to the above compressor, wherein the compression element is disposed below the driving element.

A fifth aspect of the present invention is directed to the above the compressor, further comprising a pipe which extends from the discharge port onto an oil surface of the oil reservoir in the bottom part of the sealed container.

A sixth aspect of the present invention is directed to a compressor comprising a driving element stored in a sealed container, and a compression element driven by a rotary shaft of the driving element, the compression element comprising a cylinder in which a compression space is constituted; a suction port and a discharge port which communicate with the compression space in the cylinder; a compression member whose one surface crossing an axial direction of the rotary shaft is inclined continuously between a top dead center and a bottom dead center and which is rotatably disposed in the cylinder and which compresses a fluid sucked from the suction port to discharge the fluid from the discharge port; and a vane which is disposed between the suction port and the discharge port to abut on one surface of the compression member and which partitions the compression space in the cylinder into a low pressure chamber and a high pressure chamber, wherein the compression element is disposed above the driving element, and oil is supplied to the compression element from an oil reservoir in a bottom part of the sealed container by an oil pump.

A seventh aspect of the present invention is directed to the above compressor, wherein bearings of the rotary shaft are disposed in an upper part and/or a lower part of the compression element, and a lower part of the driving element.

An eighth aspect of the present invention is directed to the above compressor, wherein the fluid is discharged from the discharge port into the sealed container, and a pressure on a side of the other surface of the compression member is set to a value which is higher than that of a pressure of the fluid sucked into the suction port and which is lower than that of a pressure in the sealed container.

A ninth aspect of the present invention is directed to the above compressor, wherein one surface of the compression member is disposed on a side opposite to the driving element, and a back pressure of the vane is set to a value which is higher than that of the pressure on the other surface side of the compression member and which is lower than that of the pressure in the sealed container.

According to the first aspect of the present invention, since one surface of the compression member is disposed on a side opposite to the driving element, a gas does not easily leak from a bearing, and the performance can be improved.

Especially even in a case where the compression element is disposed above the driving element as in the second aspect of the present invention, the gas does not easily leak, and it is therefore possible to avoid a disadvantage that a peripheral surface of the rotary shaft has a high pressure. It is possible to supply the oil to the compression element from the oil reservoir in the lower part of the sealed container by the oil pump as in the third aspect of the present invention.

Furthermore, when the back pressure of the vane is set to a value which is higher than that of the pressure of the fluid sucked into the suction port and which is lower than that of the pressure in the sealed container as in the third aspect of the present invention, the oil can be smoothly supplied to the sliding portion by the oil pump using a pressure difference.

In addition, in a case where the compression element is disposed below the driving element as in the fourth aspect of the present invention, there is disposed the pipe extending from the discharge port onto the oil surface of the oil reservoir in the lower part of the sealed container as in the fifth aspect of the present invention. Accordingly, since the fluid discharged from the discharge port is guided onto the oil surface via the pipe, pulsations of the discharged fluid can be reduced.

According to the sixth aspect of the present invention, the compression element is disposed above the driving element, and the oil is supplied to the compression element from the oil reservoir in the lower part of the sealed container by the oil pump. Therefore, the pressure of the compression member on the other surface side is set to a value which is higher than that of the pressure of the fluid sucked into the suction port and which is lower than that of the pressure in the sealed container as in the eighth aspect of the present invention. Consequently, the oil can be supplied even in a case where the compression element is disposed above the driving element.

Moreover, since the bearings of the rotary shaft are disposed in an upper part and/or a lower part of the compression element, and in a lower part of the driving element as in the seventh aspect of the present invention, the rotary shaft can be stably supported, and vibrations generated in the compressor can be effectively reduced.

Especially when one surface of the compression member is disposed on the side opposite to the driving element as in the ninth aspect of the present invention, the gas does not easily leak from the bearing, and sealability of the bearing can be improved. Furthermore, the back pressure of the vane is set to the value which is higher than that of the pressure of the compression member on the other surface side and which is lower than that of the pressure in the sealed container, and it is therefore possible to supply the oil utilizing the pressure difference.

Consequently, in the compressor in which the compression element is disposed above the driving element, the oil can be smoothly supplied, and reliability can be improved.

DETAILED DESCRIPTION OF THE PREFERRED EMBODIMENTS

Embodiments of the present invention will be described hereinafter in detail with reference to the accompanying drawings. A compressor C of each embodiment described below constitutes, e.g., a refrigerant circuit of a refrigerator, and plays a role of sucking, compressing and discharging the refrigerant into the circuit.

First Embodiment

Figure 1:
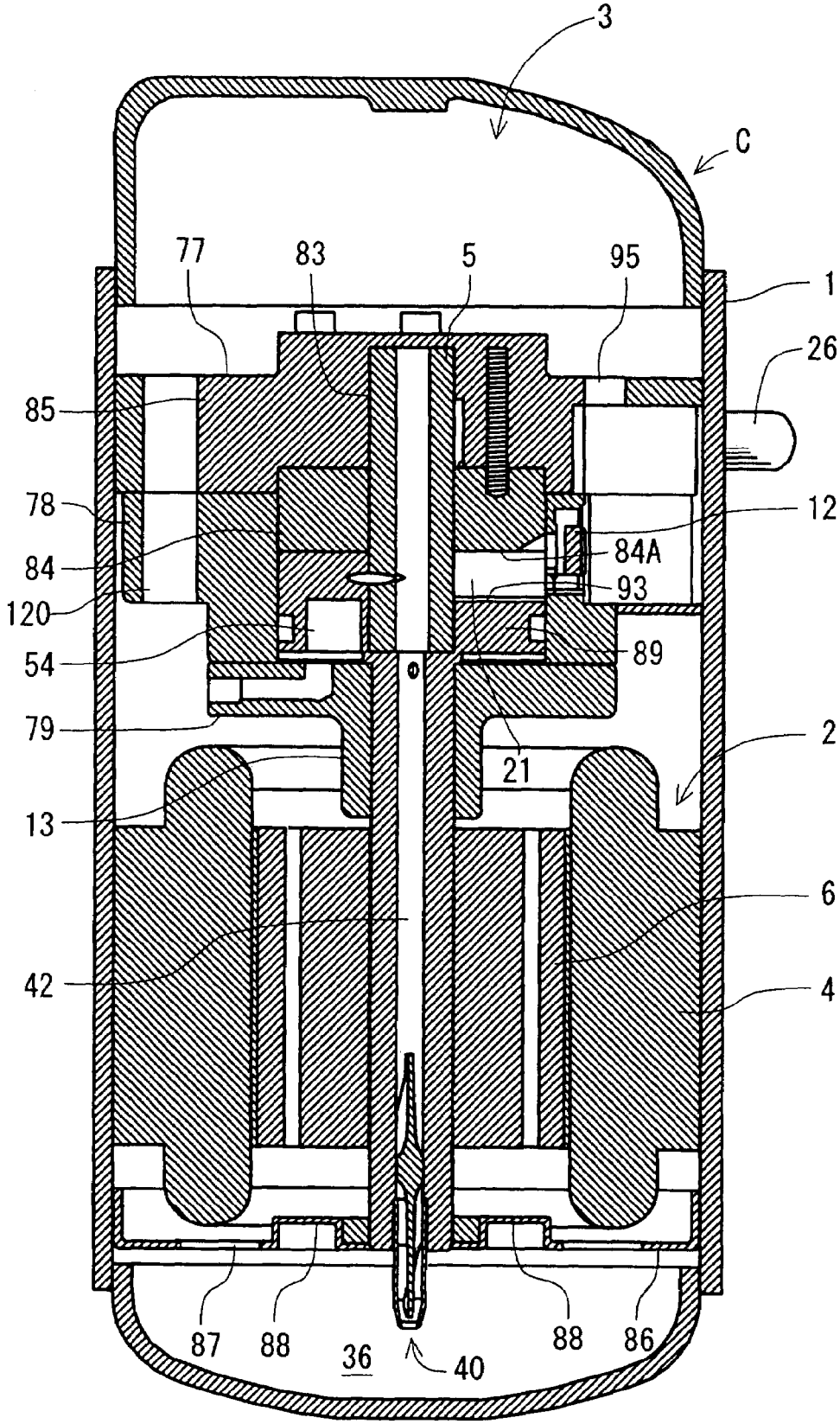
FIG. 1 is a vertical sectional side view of a compressor according to a first embodiment of the present invention.
Figure 2:
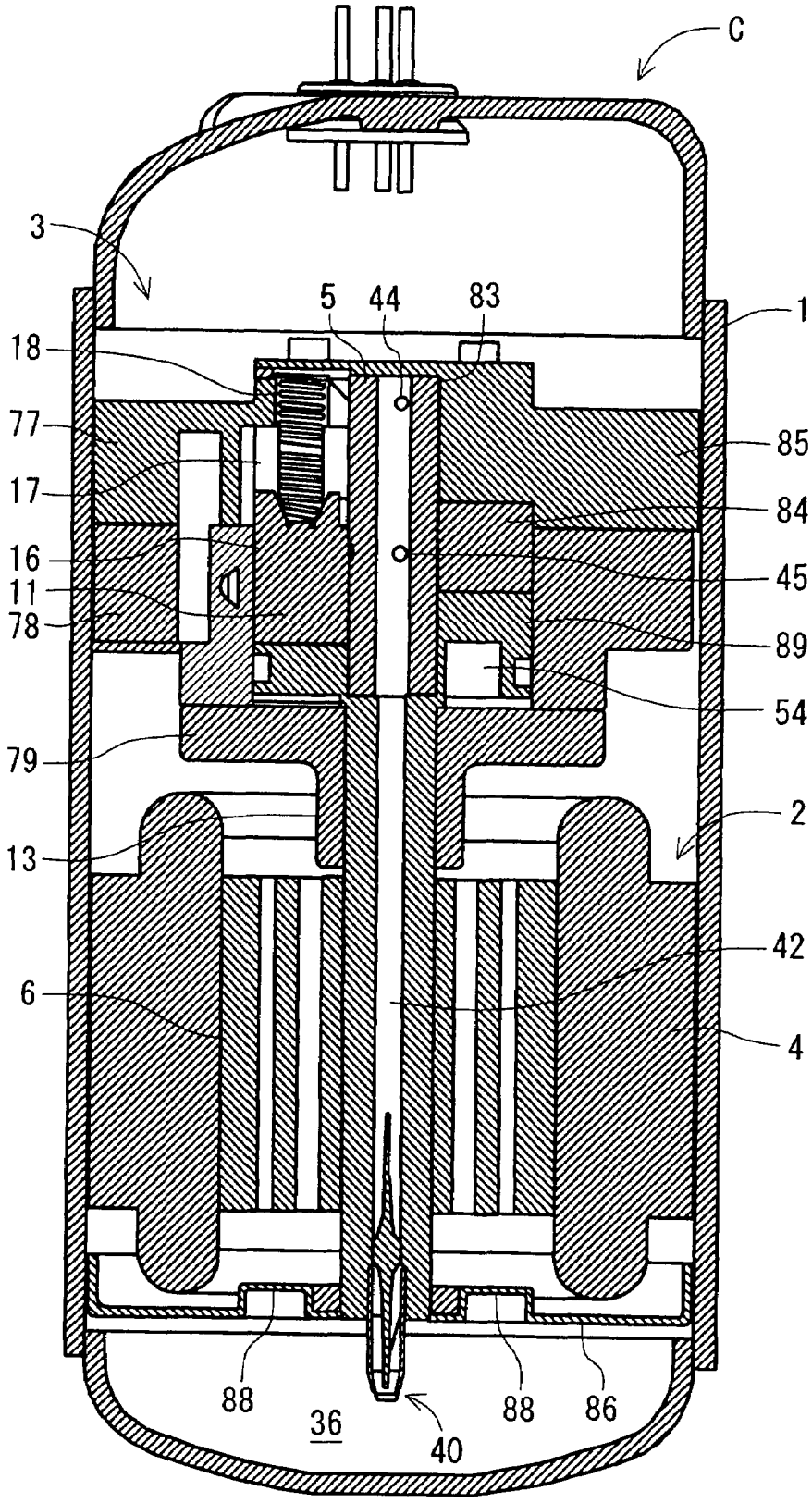
FIG. 2 is another vertical sectional side view of the compressor of FIG. 1.
Figure 3:
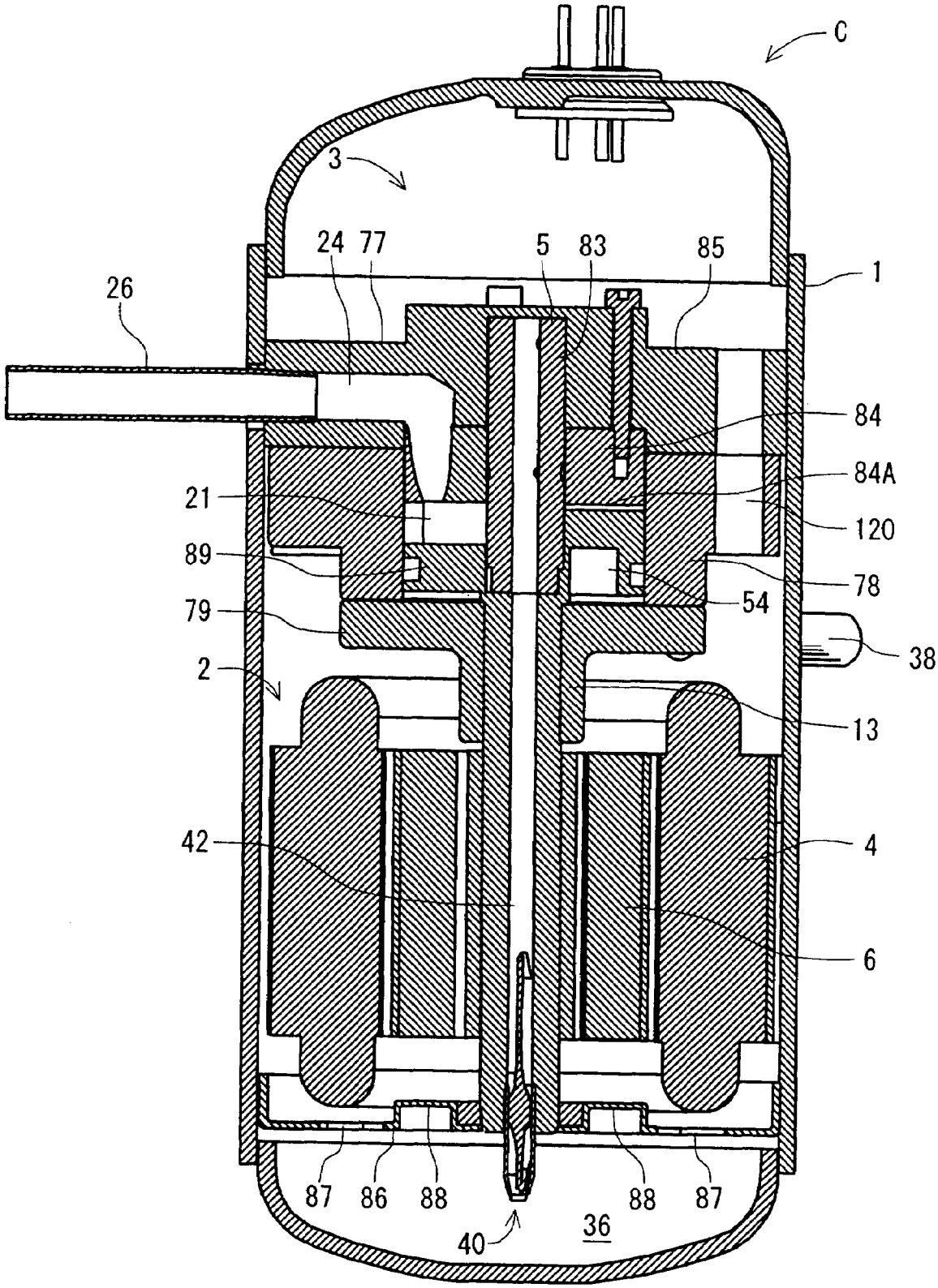
FIG. 3 is still another vertical sectional side view of the compressor of FIG. 1.
Figure 4:
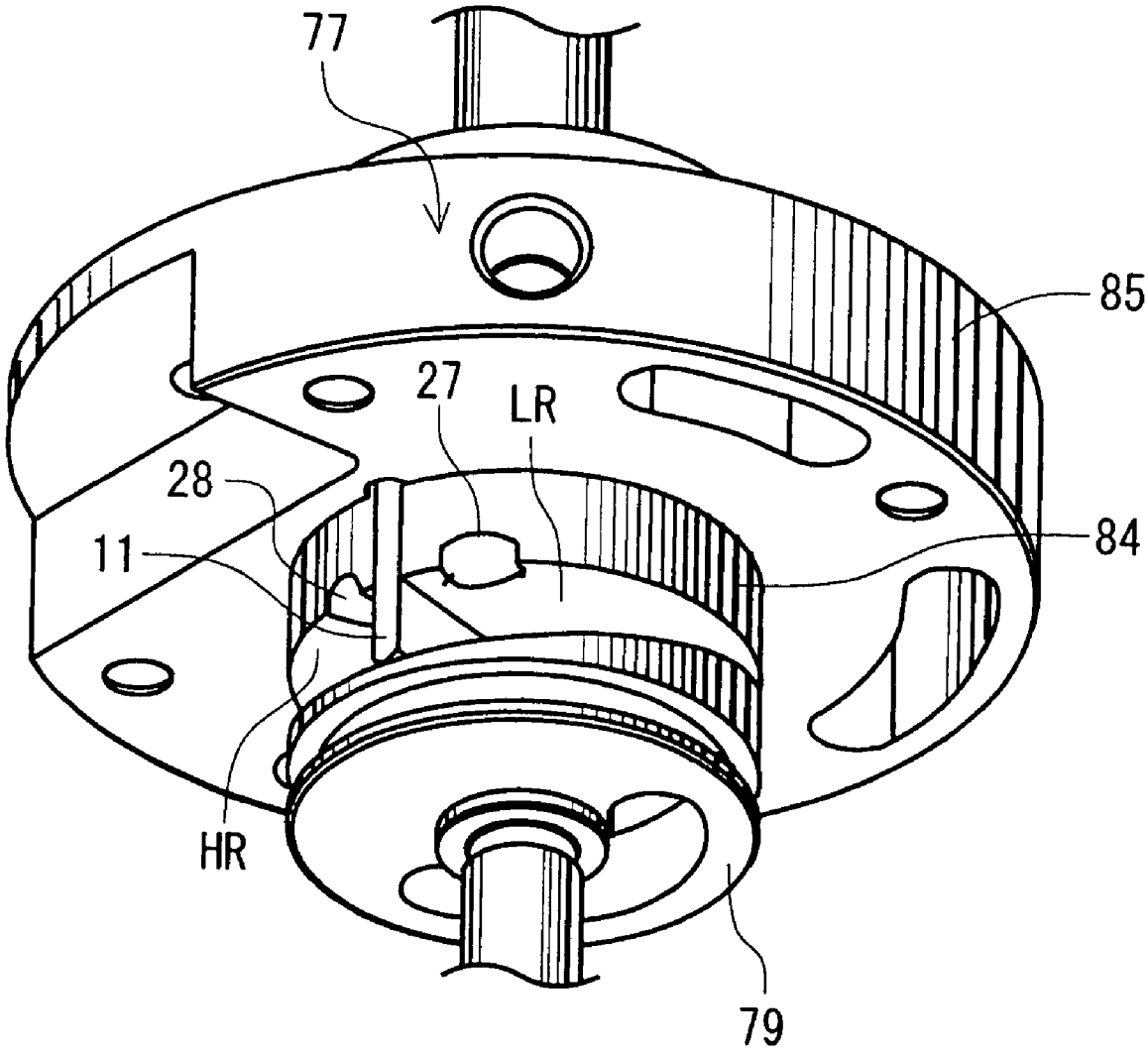
FIG. 4 is a perspective view showing a compression element of the compressor of FIG. 1.

FIG. 1 is a vertical sectional side view showing a compressor C according to a first embodiment of the present invention, FIG. 2 is another vertical sectional side view of the compressor C of FIG. 1, FIG. 3 is still another vertical sectional side view of the compressor C of FIG. 1, and FIG. 4 is a perspective view of a compression element 3 of the compressor C of the compressor C of FIG. 1, respectively.

Throughout the drawings, a reference numeral 1 denotes a sealed container which receives the compression element 3 on its upper side and a driving element 2 on its lower side. That is, the compression element 3 is disposed above the driving element 2.

The driving element 2 is an electromotive motor which is fixed to an inner wall of the sealed container 1 and which comprises a stator 4 having a stator coil wound therearound and a rotor 6 having a rotary shaft 5 in a center inside the stator 4.

The compression element 3 comprises a support member 77 fixed to the inner wall of the sealed container 1 and positioned on an upper end side of the rotary shaft 5; a cylinder 78 attached to an underside of the support member 77 by bolts; a compression member 89, a vane 11, and a discharge valve 12 arranged in the cylinder 78; a main support member 79 attached to the underside of the cylinder 78 via bolts and the like. A lower surface central portion of the main support member 79 concentrically projects downward, and a main bearing 13 of the rotary shaft 5 is formed therein. An upper surface of the main support member 79 closes a lower opening of the cylinder 78.

The support member 77 comprises a main member 85 whose outer peripheral surface is fixed to the inner wall of the sealed container 1; a sub-bearing 83 extended through the center of the main member 85; and a projected part 84 fixed to a lower surface central portion of the sub-bearing 83 by bolts. A lower surface 84A of this projected part 84 is formed into a smooth surface.

A slot 16 is formed in the projected part 84 of the support member 77, and the vane 11 is inserted into this slot 16 to reciprocate up and down. A back pressure chamber 17 is formed in an upper part of the slot 16, and a coil spring 18 is arranged as urging means in the slot 16 to urge an upper surface of the vane 11 downward.

Moreover, an upper opening of the cylinder 78 is closed by the support member 77, so that a compression space 21 is constituted inside the cylinder 78 (between the compression member 89 and the projected part 84 of the support member 77 in the cylinder 78). A suction passage 24 is formed in the main member 85 and the projected part 84 of the support member 77, and a suction pipe 26 is attached to the sealed container 1 to be connected to one end of the suction passage 24. A suction port 27 and a discharge port 28 are formed in the cylinder 78 to communicate with the compression space 21. The other end of the suction passage 24 communicates with the suction port 27. Additionally, the vane 11 is positioned between the suction port 27 and the discharge port 28 (FIG. 4).

The rotary shaft 5 is rotatably supported by the main bearing 13 formed on the main support member 79, the sub-bearing 83 formed on the support member 77, and a sub-bearing 86 formed on a lower end. That is, the rotary shaft 5 is inserted into centers of the main support member 79, the cylinder 78, and the support member 77, and its central portion of an up-and-down direction is rotatably supported by the main bearing 13. An upper part of the rotary shaft 5 is rotatably supported by the sub-bearing 83, and an upper end thereof is covered with the support member 77. Furthermore, a lower part of the rotary shaft 5 is supported by the sub-bearing 86. This sub-bearing 86 is disposed under the driving element 2, and substantially has a donut shape having a hole for passing the rotary shaft 5 in the central portion. An outer peripheral edge of the sub-bearing rises in an axial center direction, and the sub-bearing is fixed to the inner wall of the sealed container 1. Several vertically communicating holes 87 are formed in this sub-bearing 86. Recesses 88 formed in the sub-bearing 86 have a vibration absorbing function of preventing vibration transmitted from the driving element 2 or the like to the rotary shaft 5 from being transmitted to the sealed container 1 via the sub-bearing 86.

As described above, the bearings of the rotary shaft 5 are disposed in the upper part (sub-bearing 83) of the compression element 3, the lower part (main bearing 13) thereof, and in the lower part (sub-bearing 86) of the driving element 2. Consequently, the rotary shaft 5 is stably supported, and the vibration generated in the compressor C can be effectively reduced. This can achieve enhancement of a vibration characteristic of the compressor C.

Moreover, when the compression space 21 is disposed in an upper surface 93 of the compression member 89 on a side opposite to the driving element 2, gas leakage from the main bearing 13 is not easily generated, and sealability of the main bearing 13 can be enhanced. Furthermore, when the upper end of the rotary shaft 5 is closed by the support member 77, the sealability of the sub-bearing 83 is improved, and it is possible to avoid a disadvantage that a peripheral surface of the rotary shaft 5 has a high pressure.

It has heretofore been difficult to supply oil from an oil reservoir 36 in a bottom part of the sealed container 1 to a sliding portion such as the compression member 89 of the compression element 3 in a case where the compression element 3 is disposed in the upper part of the sealed container 1.

That is, since a high-pressure gas enters the peripheral surface of the rotary shaft 5 to provide the high pressure, it has not been possible to supply the oil smoothly from oil holes 44, 45 disposed in the upper part of the rotary shaft 5 and formed ranging from an oil passage 42 to the side surface of the compression element 3 in an axial direction of the rotary shaft 5.

However, when the upper end of the rotary shaft 5 is closed by the support member 77, the sealability of the sub-bearing 83 can be improved, and it is possible to avoid the disadvantage that the peripheral surface of the rotary shaft 5 has the high pressure. Therefore, it is possible to supply the oil to a sliding portion such as the compression member 89 disposed in the upper part of the sealed container 1 by an oil pump 40, and an oil supply amount can be optimized.

Moreover, the compression member 89 is formed integrally with the upper part of the rotary shaft 5, and disposed in the cylinder 78. This compression member 89 is rotated by the rotary shaft 5 to compress a fluid (refrigerant) sucked from the suction port 27 and discharge the fluid into the sealed container 1 via the discharge port 28, and has a substantially columnar shape concentric to the rotary shaft 5 as a whole.

Furthermore, the upper surface 93 (one surface) of the compression member 89 crossing an axial direction of the rotary shaft 5 exhibits an inclined shape which extends from a highest top dead center to a lowest bottom dead center to return to the top dead center and which is continuous between the top dead center and the bottom dead center.

One surface of the compression member 89 having the continuously inclined shape is disposed on the upper surface 93 which is a surface on a side opposite to the driving element 2 stored in the lower part of the sealed container 1 of the compression member 89.

On the other hand, the vane 11 is disposed between the suction port 27 and the discharge port 28, and abuts on the upper surface 93 of the compression member 89 to partition the compression space 21 of the cylinder 78 into a low pressure chamber LR and a high pressure chamber HR. The coil spring 18 always urges the vane 11 toward the upper surface 93.

A lower opening of the cylinder 78 is closed by the sub-support member 79, and a space 54 is formed between the lower surface (the other surface) of the compression member 89 and the main support member 79 (on a back-surface side of the compression space 21). This space 54 is a space sealed by the compression member 89 and the main support member 79. Moreover, a slight amount of the refrigerant flows from the compression space 21 into the space 54 via a clearance between the compression member 89 and the cylinder 78. Therefore, the pressure of the space 54 is set to a value (intermediate pressure) which is higher than that of a low-pressure refrigerant sucked into the suction port 27 and which is lower than that of a high-pressure refrigerant in the sealed container 1.

When the pressure of the space 54 is set to the intermediate pressure in this manner, it is possible to avoid a disadvantage that the compression member 89 is strongly pushed upward by the pressure of the space 54 and that the upper surface 93 of the compression member 89 as a receiving surface, and the lower surface 84A of the projected part 84 are remarkably worn. Consequently, durability of the upper surface 93 of the compression member 89 can be improved.

Furthermore, when the pressure of the space 54 on the other surface side of the compression member 89 is set to the intermediate pressure, the pressure of the space 54 is lower than that in the sealed container 1. Therefore, it is possible to supply the oil smoothly to the compression member 89 which is a peripheral portion of the space 54, or the vicinity of the main bearing 13 utilizing the pressure difference.

On the other hand, the back pressure chamber 17 is not set to the high pressure unlike a conventional technology. The pressure of the back pressure chamber 17 as the sealed space is set to a value which is higher than that of the pressure of the refrigerant sucked into the suction port 27 and which is lower than that of the pressure in the sealed container 1. In the conventional technology, a part of the back pressure chamber 17 is allowed to communicate with the inside of the sealed container 1, and the inside of the back pressure chamber 17 is set to a high pressure to urge the vane 11 downward in addition to the coil spring 18. However, in the present embodiment, the compression element 3 is positioned in the upper part of the sealed container 1. Therefore, when the back pressure chamber 17 is set to the high pressure, the oil supplied to the vicinity of the vane 11 might be insufficient.

Here, the back pressure chamber 17 is formed into a sealed space without being allowed to communicate with the inside of the sealed container 1. Accordingly, the refrigerant only slightly flows into the back pressure chamber 17 from low and high pressure chamber sides of the compression space 21 via the gap of the vane 11. Therefore, the back pressure chamber 17 has an intermediate pressure which is higher than the pressure of the refrigerant sucked into the suction port 27 and which is lower than the pressure inside the sealed container 1. Accordingly, since the pressure inside the back pressure chamber 17 is lower than that in the sealed container 1, the oil rises through the oil passage 42 in the rotary shaft 5 utilizing the pressure difference, and the oil can be supplied from the oil holes 44, 45 to the peripheral portion of the vane 11.

Consequently, even when the compression element 3 is disposed in the upper part of the sealed container 1, the oil can be smoothly supplied to sliding portions such as the compression member 89 and the vane 11, and reliability of the compressor C can be improved.

Moreover, a very small clearance is formed between a peripheral side face of the compression member 89 and an inner wall of the cylinder 78, whereby the compression member 89 freely rotates. The clearance between the peripheral side face of the compression member 89 and the inner wall of the cylinder 78 is also sealed with oil.

The discharge valve 12 is mounted on an outer side of the discharge port 28 to be positioned in a side face of the compression space 21 of the cylinder 78, and a discharge pipe 95 is formed in the cylinder 78 and the support member 77 in such a manner as to allow the discharge valve 12 to communicate with the upper part of the sealed container 1. That is, the refrigerant compressed in the cylinder 78 is discharged from the discharge port 28 into the upper part of the sealed container 1 via the discharge valve 12 and the discharge pipe 95.

Moreover, a through hole 120 extending through the cylinder 78 and the support member 77 in the axial center direction (vertical direction) is formed in a position substantially symmetric with the discharge valve 12 in the cylinder 78 and the support member 77. A discharge pipe 38 is attached to a position corresponding to a lower portion under the through hole 120 in the side surface of the sealed container 1. The refrigerant discharged from the discharge pipe 95 to the upper part of the sealed container as described above passes through the through hole 120, and is discharged from the discharge pipe 38 to the outside of the compressor C. It is to be noted that the oil pump 40 is disposed on a lower end of the rotary shaft 5, and one end of the pump is immersed in the oil reservoir 36 in a bottom part of the sealed container 1. Moreover, the oil pumped up by the oil pump 40 is supplied to the sliding portion or the like of the compression element 3 via the oil passage 42 formed in the center of the rotary shaft 5 and the oil holes 44, 45 formed ranging from the oil passage 42 to the side surface of the compression element 3 in the axial direction of the rotary shaft 5. In the sealed container 1, a predetermined amount of, for example, carbon dioxide ($CO_2$), R-134a, or HC-based refrigerant is sealed in.

According to the aforementioned constitution, when power is supplied to the stator coil of the stator 4 of the driving element 2, the rotor 6 is rotated clockwise (seen from the bottom). The rotation of the rotor 6 is transmitted through the rotary shaft 5 to the compression member 89, whereby the compression member 89 is rotated clockwise in the cylinder 78 (seen from the bottom). Now, it is assumed that the top dead center of the upper surface 93 of the compression member 89 is on the vane 11 side of the discharge port 28, and the refrigerant in a refrigerant circuit is sucked from the suction port 27 through the suction pipe 26 and the suction passage 24 into a space (low pressure chamber) surrounded with the cylinder 78, the support member 77, the compression member 89 and the vane 11 on the suction port 27 side of the vane 11.

Moreover, when the compression member 89 is rotated in this state, a volume of the space is narrowed due to inclination of the upper surface 93 from a stage at which the top dead center passes through the vane 11 and the suction port 27, and the refrigerant in a space (high pressure chamber) is compressed. Then, the refrigerant compressed until the top dead center passes through the discharge port 28 is continuously discharged from the discharge port 28. On the other hand, after the passage of the top dead center through the suction port 27, the volume of the space (low pressure chamber) surrounded with the cylinder 78, the support member 79, the compression member 89, and the vane 11 on the suction port 27 side of the vane 11 is expanded. Accordingly, the refrigerant is sucked from the refrigerant circuit through the suction pipe 26, the suction passage 24, and the suction port 27 into the compression space 21.

The refrigerant is discharged from the discharge port 28 through the discharge valve 12 and the discharge pipe 95 into the upper part of the sealed container 1. Then, the high-pressure refrigerant discharged into the sealed container 1 passes through the upper part of the sealed container 1, and is discharged through the communication hole 120 formed in the support member 77 and the cylinder 78 into the refrigerant circuit via the discharge pipe 38. On the other hand, the separated oil flows down through the communication hole 120, and further flows down from between the sealed container 1 and the stator 4 to return into the oil reservoir 36.

It is to be noted that in the present embodiment, the back pressure chamber 17 is formed into the sealed space, and the pressure of the back pressure chamber 17 applied as the back pressure of the vane 11 is set to a value which is higher than that of the pressure of the refrigerant sucked into the suction port 27 and which is lower than that of the pressure in the sealed container 1. The present invention is not limited to a case where the back pressure chamber 17 is formed into the sealed space in this manner. For example, the back pressure chamber 17 may communicate with the inside of the sealed container 1 via a small passage (nozzle). In this case, since the refrigerant flows from the sealed container 1 through the nozzle into the back pressure chamber 17, the pressure of the refrigerant drops while the refrigerant passes through the nozzle. Accordingly, the back pressure chamber 17 has a value which is higher than that of the pressure of the refrigerant sucked into the suction port 27 and which is lower than that of the pressure in the sealed container 1. Therefore, the oil can be smoothly supplied to the peripheral portion of the vane 11 utilizing the pressure difference. When a diameter of the nozzle is adjusted, the pressure of the refrigerant flowing into the back pressure chamber 17 can be freely set.

Moreover, in the same manner as in the back pressure chamber 17, the space 54 as the sealed space on the other surface side of the compression member 89 has an intermediate pressure which is higher than the pressure of the low-pressure refrigerant sucked into the suction port 27 and which is lower than the pressure of the high-pressure refrigerant in the sealed container 1. However, the space 54 may be allowed to communicate with the inside of the sealed container 1 via the small passage (nozzle). In this case, since the refrigerant flows from the sealed container 1 through the nozzle into the space 54, the pressure of the refrigerant drops while the refrigerant passes through the nozzle. Accordingly, the space 54 indicates a value which is higher than that of the pressure of the refrigerant sucked into the suction port 27 and which is lower than that of the pressure in the sealed container 1. Therefore, it is possible to avoid a disadvantage that the upper surface 93 of the compression member 89 which is the receiving surface, and the lower surface 84A of the projected part 84 are remarkably worn. Consequently, the durability of the upper surface 93 of the compression member 89 can be improved. Furthermore, when the space 54 is set to such intermediate pressure, it is possible to supply the oil smoothly to the compression member 89 which is the peripheral portion of the space 54, or the vicinity of the main bearing 13 utilizing the pressure difference. When the diameter of the nozzle is adjusted, the pressure of the refrigerant flowing into the space 54 can be freely set.

Furthermore, in the present embodiment, the bearings of the rotary shaft 5 are disposed in three places: the upper part (sub-bearing 83) and the lower part (main bearing 13) of the compression element 3; and the lower part (sub-bearing 86) of the driving element 2, but may be disposed in two places: the upper part of the compression element 3 and the lower part of the driving element 2; or the lower part of the compression element 3 and the lower part of the driving element 2. Even in this case, the rotary shaft 5 can be sufficiently supported.

Second Embodiment

Figure 5:
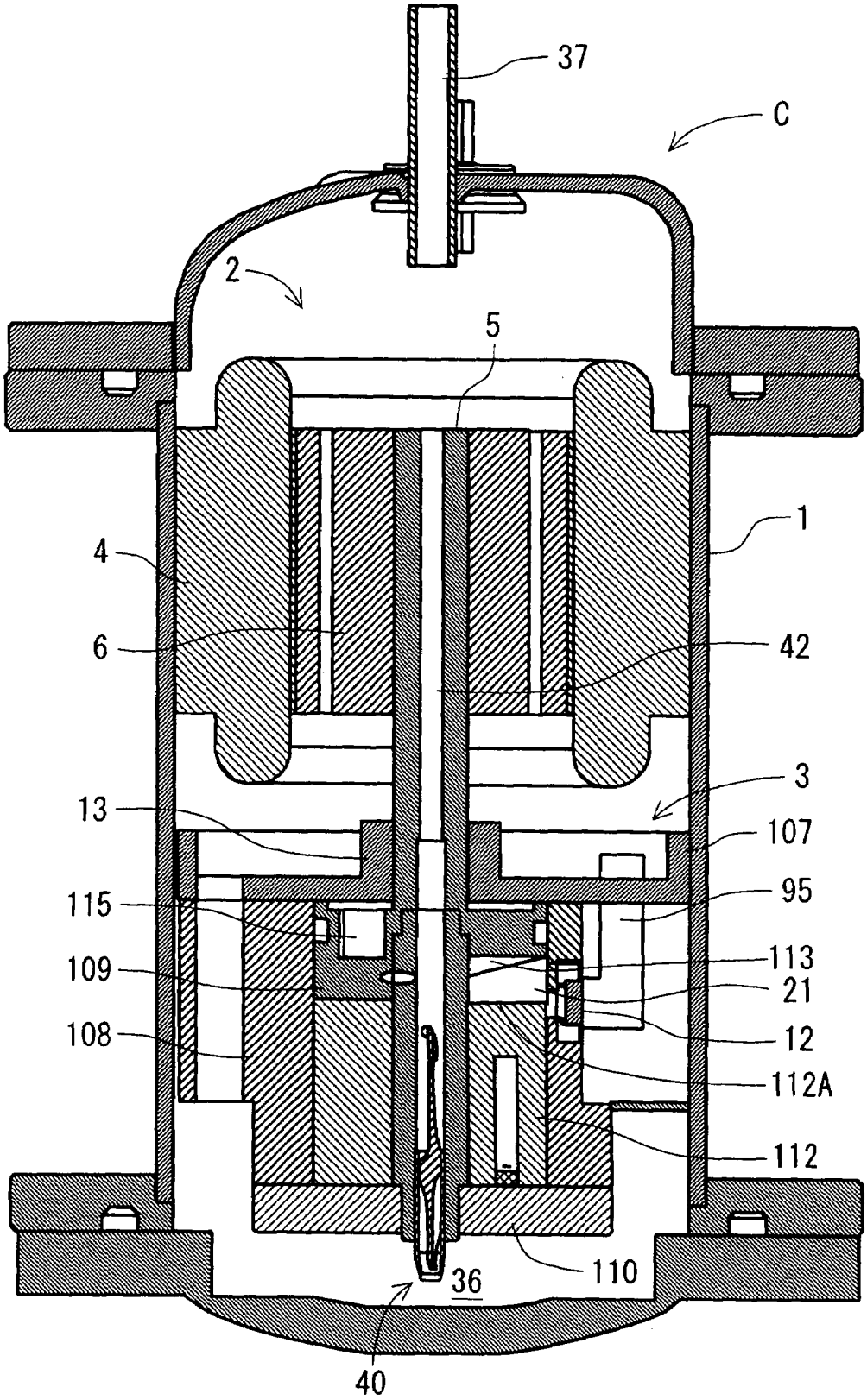
FIG. 5 is a vertical sectional side view showing the compression element of the compressor according to a second embodiment of the present invention.
Figure 6:
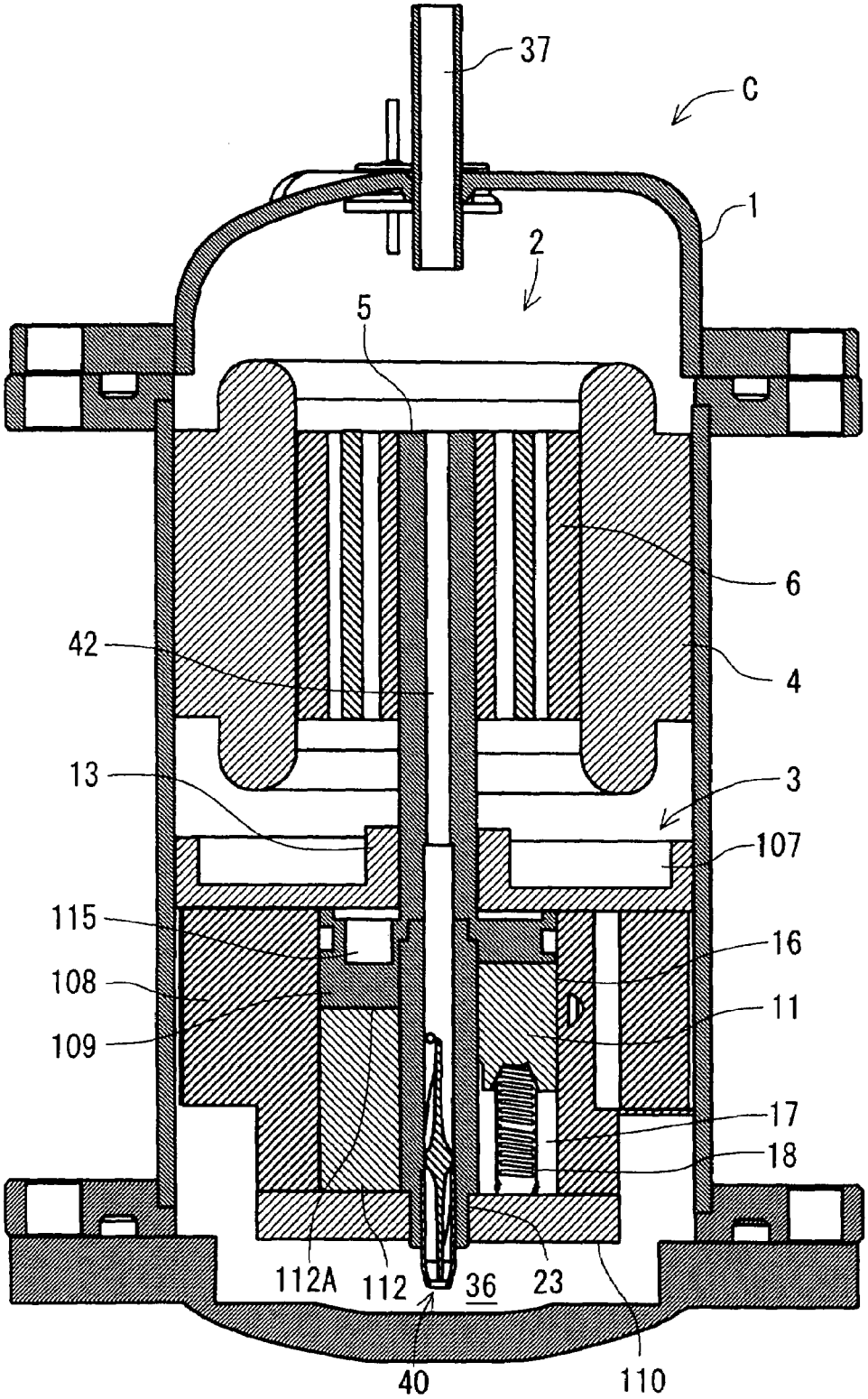
FIG. 6 is another vertical sectional side view of the compressor of FIG. 5.
Figure 7:
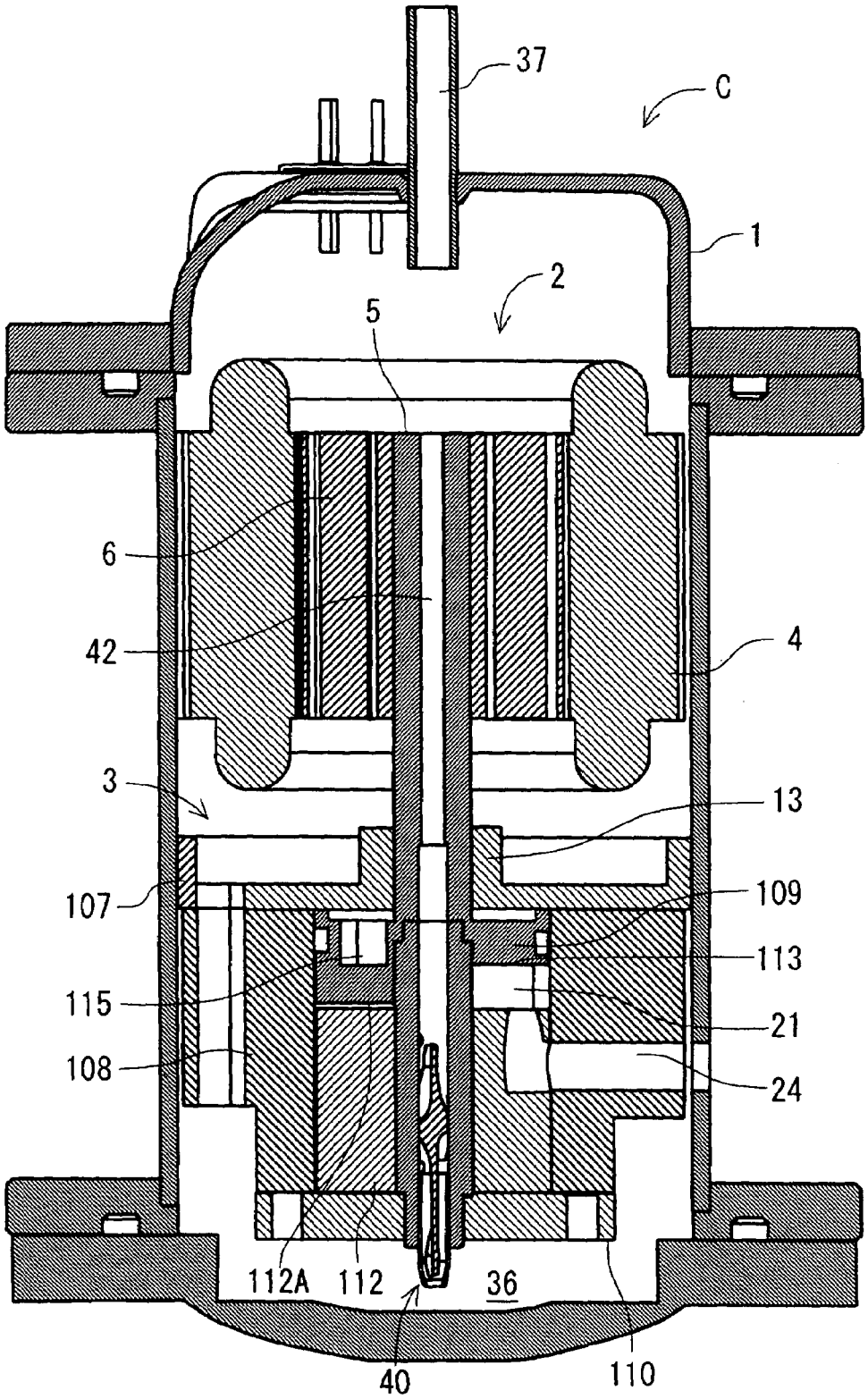
FIG. 7 is still another vertical sectional side view of the compressor of FIG. 5.

Next, a second embodiment of the present invention will be described with reference to FIGS. 5 to 7. FIGS. 5 to 7 are vertical sectional side views of a compressor C in this case, and the respective figures show different sections, respectively. It is to be noted that in FIGS. 5 to 7, components denoted with the same reference numerals as those of FIGS. 1 to 4 produce similar effects, and description thereof is therefore omitted.

In the present embodiment, a driving element 2 is disposed in an upper part of a sealed container 1, and a compression element 3 is disposed in a lower part of the container. That is, the compression element 3 is disposed below the driving element 2.

The compression element 3 comprises a main support member 107 fixed to an inner wall of the sealed container 1; a cylinder 108 attached to an underside of the main support member 107 by bolts; a compression member 109, a vane 11, and a discharge valve 12 arranged in the cylinder 108; a sub-support member 110 attached to an underside of the cylinder 108 via bolts and the like. An upper surface central portion of the main support member 107 concentrically projects upward, and a main bearing 13 of a rotary shaft 5 is formed therein. An outer peripheral edge of the main bearing rises in an axial center direction (upward direction), and the raised outer peripheral edge is fixed to the inner wall of the sealed container 1 as described above.

Moreover, an upper opening of the cylinder 108 is closed by the main support member 107, and accordingly a sealed space 115 closed by the compression member 109 and the main support member 107 is formed between the upper surface (the other surface) of the compression member 109 disposed in the cylinder 108 and the main support member 107 (the other surface side of the compression member 109).

The sub-support member 110 comprises a main body, a sub-bearing 23 extended through a center of the main body, and a projected part 112 fixed to the upper surface central portion of the sub-support member by bolts. An upper surface 112A of the projected part 112 is formed into a smooth surface.

Moreover, a lower opening of the cylinder 108 is closed by the projected part 112 of the sub-support member 110, and accordingly a compression space 21 is formed inside the cylinder 108 (the inside of the cylinder 108 between the compression member 109 and the projected part 112 of the sub-support member 110).

A slot 16 is formed in the projected part 112 of the sub-support member 110, and the vane 11 is inserted into this slot 16 to reciprocate up and down. A back pressure chamber 17 is formed in a lower part of the slot 16, and a coil spring 18 is arranged as urging means in the slot 16 to urge the lower surface of the vane 11 upward.

Moreover, a suction passage 24 is formed in the cylinder 108 and the projected part 112 of the sub-support member 110, and a suction pipe (not shown) is mounted in the sealed container 1, and connected to one end of the suction passage 24. A suction port 27 and a discharge port 28 which communicate with the compression space 21 are formed in the cylinder 108, and the other end of the suction passage 24 communicates with the suction port 27. The vane 11 is positioned between the suction port 27 and the discharge port 28.

The rotary shaft 5 is rotatably supported by the main bearing 13 formed on the main support member 107 and the sub-bearing 23 formed on the sub-support member 110. That is, the rotary shaft 5 is inserted into centers of the main support member 107, the cylinder 108, and the sub-support member 110, and its central portion of an up-and-down direction is rotatably supported by the main bearing 13. A lower end of the rotary shaft is rotatably supported by the sub-bearing 23 of the sub-support member 110. Moreover, the compression member 109 is formed integrally in a position below the center of the rotary shaft 5, and disposed in the cylinder 108.

This compression member 109 is disposed in the cylinder 108, and rotated by the rotary shaft 5 to compress a fluid (refrigerant in the present embodiment) sucked from the suction port 27 and discharge the fluid from the discharge port 28 into the sealed container 1 via the discharge valve 12 and the discharge pipe 95. The member has a substantially columnar shape concentric to the rotary shaft 5 as a whole. The compression member 109 has a shape in which a thick part on one side is continuous with a thin part on the other side, and a lower surface 113 (one surface) crossing an axial direction of the rotary shaft 5 is an inclined surface which is low in the thick part and high in the thin part. That is, the lower surface 113 has an inclined shape which extends from a highest top dead center to a lowest bottom dead center to return to the top dead center and which is continuous between the top dead center and the bottom dead center (not shown).

One surface of the compression member 109 having the continuously inclined shape is disposed on the lower surface 113 which is a surface on a side opposite to the driving element 2 stored above the compression member 109 in the sealed container 1.

Moreover, the discharge pipe 95 of the present embodiment is a pipe which extends from the discharge port 28 onto an oil surface of an oil reservoir 36 in a bottom part of the sealed container 1. The refrigerant compressed in the cylinder 108 is discharged from the discharge port 28 through the discharge valve 12 and the discharge pipe 95 onto the oil surface in the sealed container 1.

It is to be noted that the shape of the lower surface 113 of the compression member 109 is a shape continuously inclined between the top dead center and the bottom dead center. One surface of the compression member 109 having the continuously inclined shape is disposed on the lower surface 113 which is the surface on the side opposite to the driving element 2 stored above the compression member 109 in the sealed container 1.

On the other hand, the vane 11 is disposed between the suction port 27 and the discharge port 28 as described above, and abuts on the lower surface 113 of the compression member 109 to partition the compression space 21 of the cylinder 108 into a low pressure chamber LR and a high presser chamber HR. The coil spring 18 always urges the vane 11 toward the lower surface 113.

Moreover, the space 115 is a space sealed by the compression member 109 and the main support member 107 as described above. However, since the refrigerant slightly flows from the clearance between the compression member 109 and the cylinder 108 into the space, the space 115 has an intermediate pressure which is higher than the pressure of a low-pressure refrigerant sucked into the suction port 27 and which is lower than the pressure of a high-pressure refrigerant in the sealed container 1.

When the pressure of the space 115 is set to the intermediate pressure in this manner, it is possible to avoid a disadvantage that the compression member 109 is strongly pressed upward by the pressure of the space 115 and that the lower surface 113 of the compression member 109 as the receiving surface, and the upper surface 112A of the projected part 112 are remarkably worn. Consequently, durability of the lower surface 113 of the compression member 109 can be improved.

Moreover, when the pressure of the space 115 on the other surface side of the compression member 109 is set to the intermediate pressure, the pressure in the space 115 becomes lower than that in the sealed container 1.

Therefore, it is possible to supply the oil smoothly to the compression member 109 which is a peripheral portion of the space 115, or the vicinity of the main bearing 13 utilizing the pressure difference.

Furthermore, since the compression space 21 is disposed in the lower surface 113 of the compression member 109 on a side opposite to the driving element 2, gas leakage from the main bearing 13 is not easily generated, and sealability of the main bearing 13 can be enhanced. Since the sub-bearing 23 on the lower surface 113 side of the compression member 109 forming the compression space 21 is positioned in the oil reservoir 36, the gas leakage from the sub-bearing 23 can be avoided by the oil. The sealability of the sub-bearing 23 is enhanced, and it is possible to avoid a disadvantage that the peripheral surface of the rotary shaft 5 has a high pressure. Consequently, it is possible to perform the smooth oil supply utilizing the pressure difference.

In addition, in the same manner as in the above-described embodiment, the back pressure chamber 17 is not set to the high pressure unlike a conventional technology. The pressure of the back pressure chamber 17 as a sealed space is set to a value which is higher than that of the pressure of the refrigerant sucked into the suction port 27 and which is lower than that of the pressure in the sealed container 1. Therefore, since the pressure in the back pressure chamber 17 is lower than that in the sealed container 1, the oil rises through an oil passage 42 in the rotary shaft 5 utilizing the pressure difference, and the oil can be supplied from oil holes formed ranging from the oil passage 42 to a side surface of the compression member 109 in an axial direction of the rotary shaft 5 to the peripheral portion of the vane 11.

Moreover, a very small clearance is formed between a peripheral side face of the compression member 109 and an inner wall of the cylinder 108, whereby the compression member 109 freely rotates. The clearance between the peripheral side face of the compression member 109 and the inner wall of the cylinder 108 is also sealed with oil.

Furthermore, the discharge valve 12 is mounted to an outer side of the discharge port 28 to be positioned in a side face of the compression space 21 of the cylinder 108, and a discharge pipe 95 is formed externally with respect to the discharge valve 12 in the cylinder 108 and the main support member 107. An upper end of the discharge pipe 95 opens in the oil surface in the oil reservoir 36.

In this manner, the refrigerant gas discharged from the discharge port 28 is passed through the discharge pipe 95, and guided onto the oil surface, so that pulsations of the discharged refrigerant can be reduced.

As described above in detail, even in the present embodiment, the oil can be smoothly supplied to sliding portions such as the compression member 109 and the vane 11, and reliability of the compressor C can be improved. In the first embodiment, the bearings of the rotary shaft 5 are disposed in three places: the upper part (sub-bearing 83) of the compression element 3; the lower part (main bearing 13) of the element; and the lower part (sub-bearing 86) of the driving element 2. However, in the present embodiment, since the rotary shaft 5 can be sufficiently supported by two bearings: the main bearing 13; and the sub-bearing 23, the number of components can be reduced, and the compressor can be inexpensively constituted.

It is to be noted that in the present embodiment, in the same manner as in the above-described embodiment, the back pressure chamber 17 is formed into the sealed space, and the pressure of the back pressure chamber 17 applied as the back pressure of the vane 11 is set to a value which is higher than that of the pressure of the refrigerant sucked into the suction port 27 and which is lower than that of the pressure in the sealed container 1. The present invention is not limited to a case where the back pressure chamber 17 is formed into the sealed space in this manner. For example, the back pressure chamber 17 may communicate with the inside of the sealed container 1 via a small passage (nozzle). In this case, since the refrigerant flows from the sealed container 1 through the nozzle into the back pressure chamber 17, the pressure of the refrigerant drops while the refrigerant passes through the nozzle. Accordingly, the back pressure chamber 17 has a value which is higher than that of the pressure of the refrigerant sucked into the suction port 27 and which is lower than that of the pressure in the sealed container 1. Therefore, the oil can be smoothly supplied to the peripheral portion of the vane 11 utilizing the pressure difference. When a diameter of the nozzle is adjusted, the pressure of the refrigerant flowing into the back pressure chamber 17 can be freely set.

Moreover, in the same manner as in the back pressure chamber 17, the space 115 as the sealed space on the other surface side of the compression member 109 has an intermediate pressure which is higher than the pressure of the low-pressure refrigerant sucked into the suction port 27 and which is lower than the pressure of the high-pressure refrigerant in the sealed container 1. However, the space 115 may be allowed to communicate with the inside of the sealed container 1 via the small passage (nozzle). In this case, since the refrigerant flows from the sealed container 1 through the nozzle into the space 115, the pressure of the refrigerant drops while the refrigerant passes through the nozzle. Accordingly, the space 115 indicates a value which is higher than that of the pressure of the refrigerant sucked into the suction port 27 and which is lower than that of the pressure in the sealed container 1. Therefore, it is possible to avoid a disadvantage that the lower surface 113 of the compression member 109 which is a receiving surface, and the upper surface 112A of the projected part 112 are remarkably worn. Consequently, the durability of the lower surface 113 of the compression member 109 can be improved. Furthermore, when the space 115 is set to such intermediate pressure, it is possible to supply the oil smoothly to the compression member 109 which is the peripheral portion of the space 115, or the vicinity of the vane 11 utilizing the pressure difference. When the diameter of the nozzle is adjusted, the pressure of the refrigerant flowing into the space 115 can be freely set.

Third Embodiment

Figure 8:
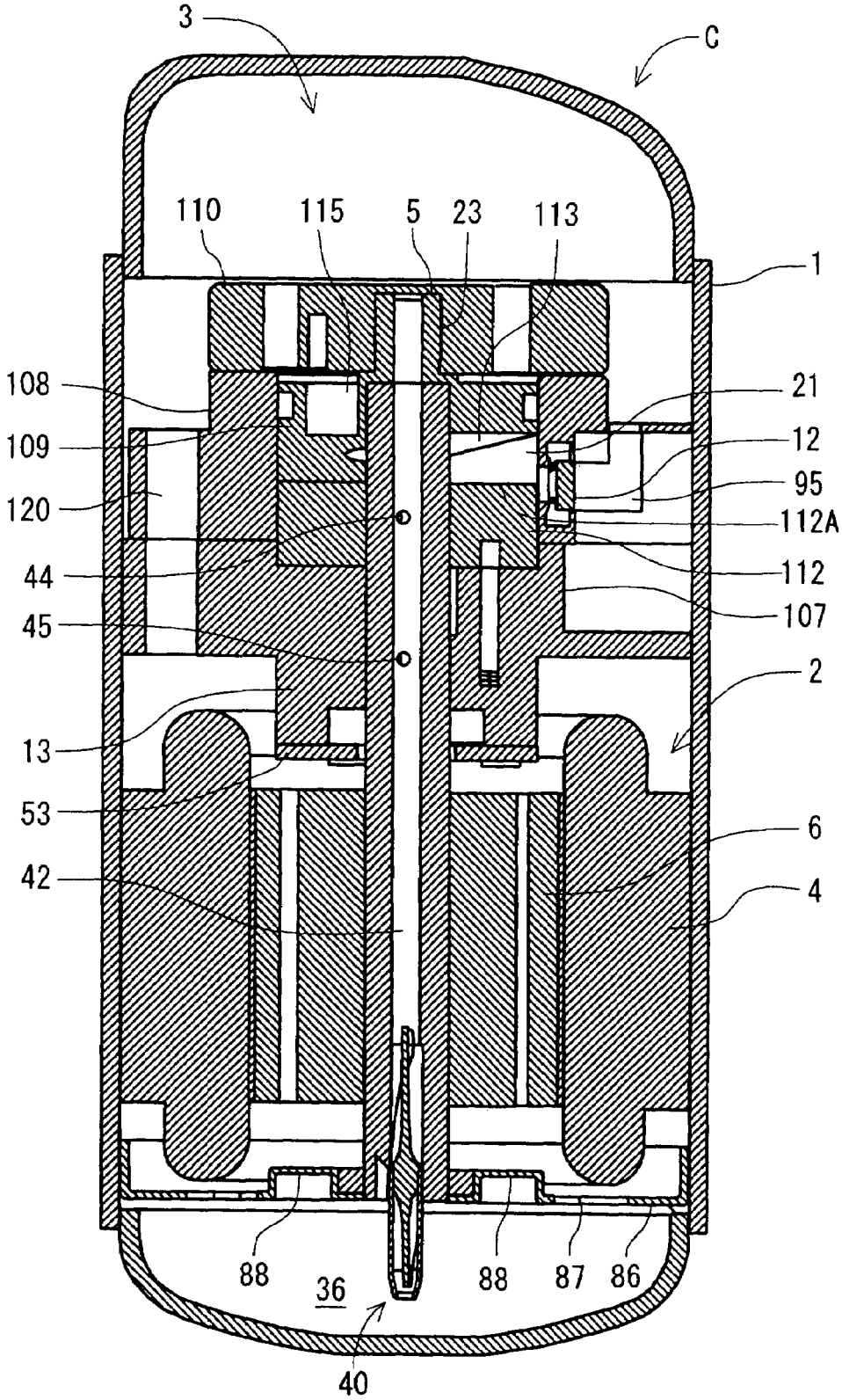
FIG. 8 is a vertical sectional side view showing the compression element of the compressor according to a third embodiment of the present invention.
Figure 9:
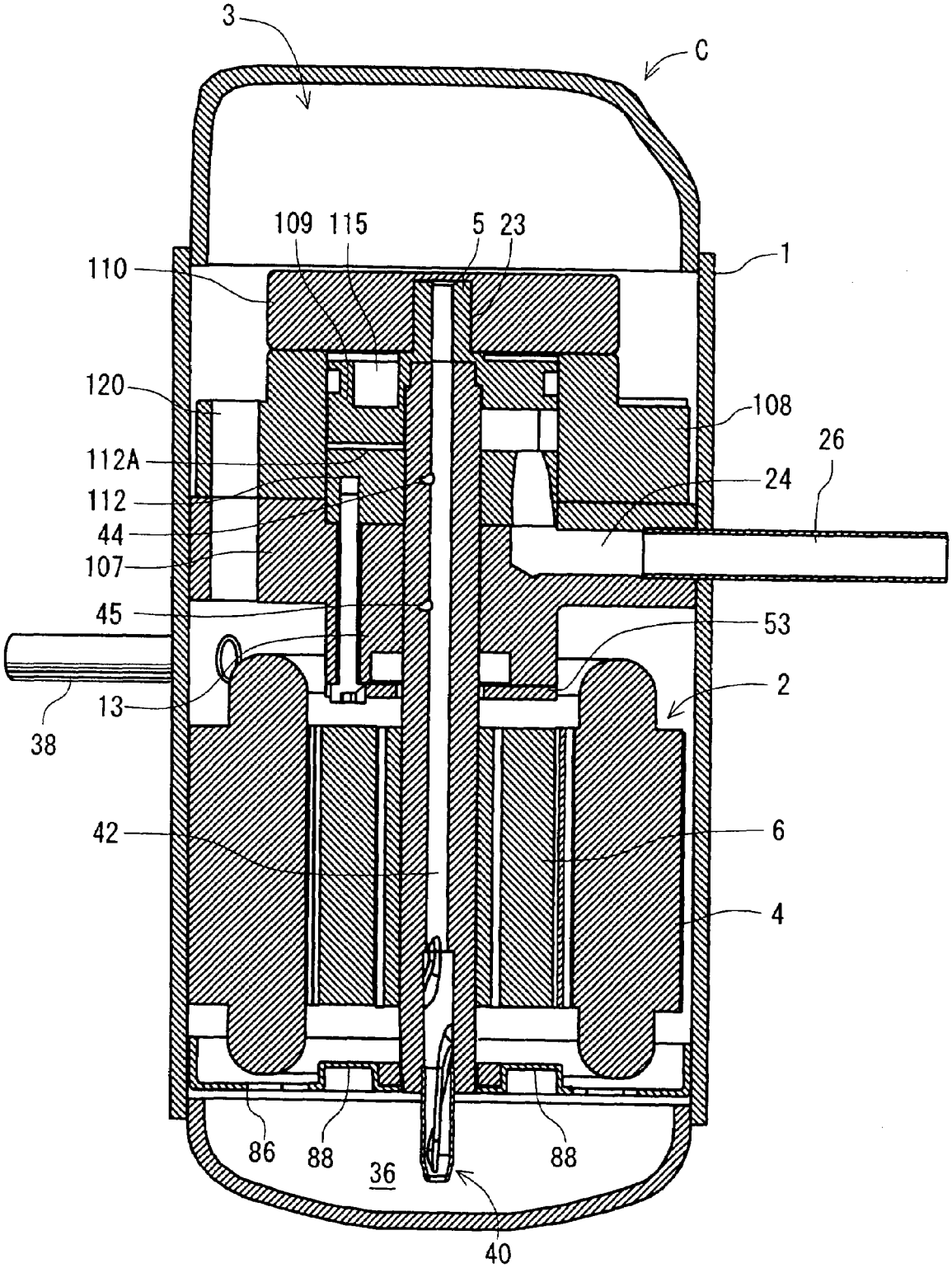
FIG. 9 is another vertical sectional side view of the compressor of FIG. 8.
Figure 10:
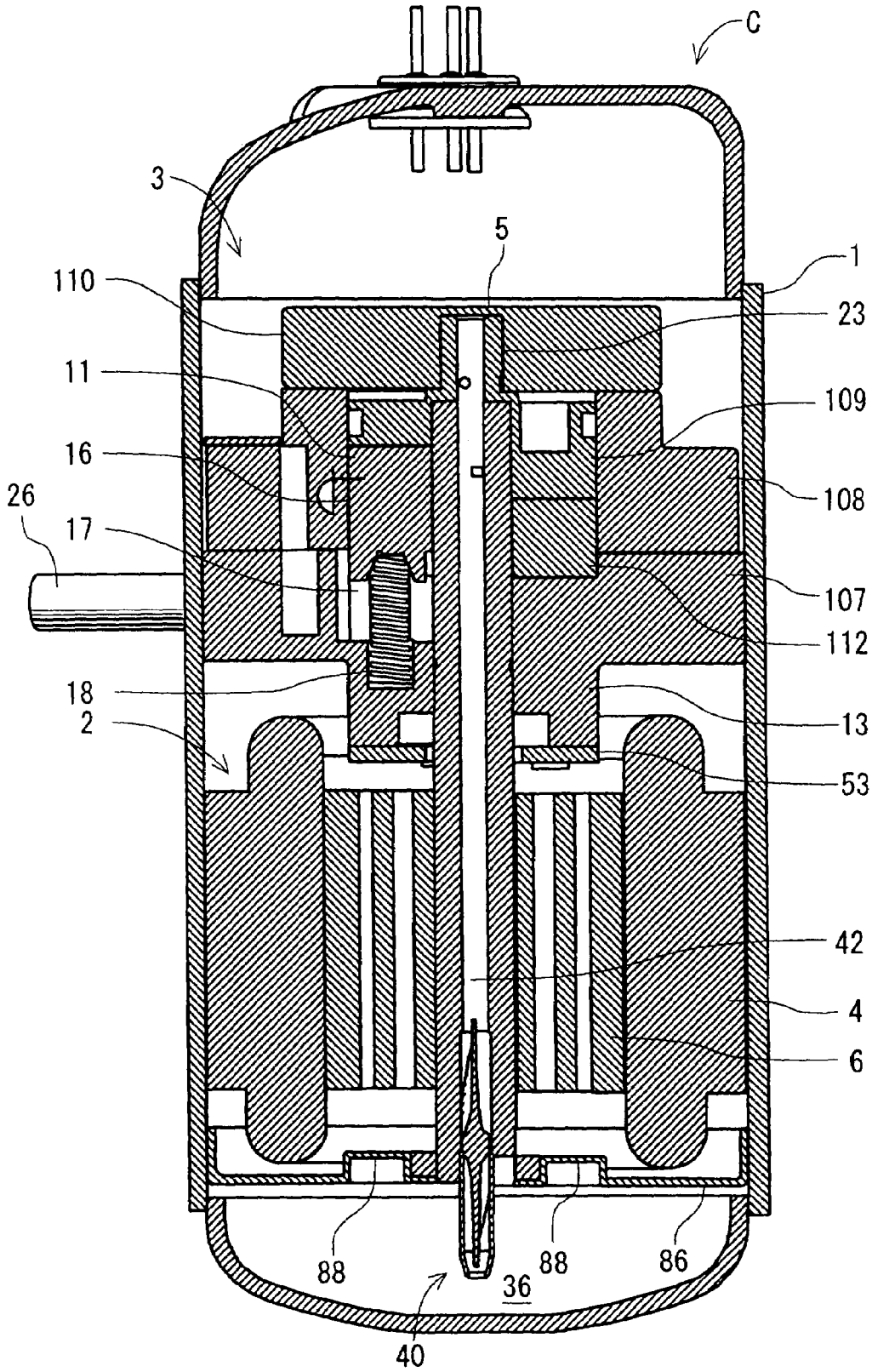
FIG. 10 is still another vertical sectional side view of the compressor of FIG. 8.

Next, FIGS. 8 to 10 show a compressor C of a third embodiment of the present invention, FIGS. 8 to 10 are vertical sectional side views of the compressor C of the third embodiment, and the respective figures show different sections. It is to be noted that in FIGS. 8 to 10, components denoted with the same reference numerals as those of FIGS. 1 to 7 produce similar effects, and description thereof is therefore omitted.

In this case, a driving element 2 is disposed in a lower part of a sealed container 1, and a compression element 3 is disposed in an upper part of the container. A compression space 21 of the compression element 3 is disposed on a lower surface side which is a driving element 2 side of a compression member 109, and a lower surface (one surface) 113 of the compression member 109 is formed into a shape inclined continuously between an top dead center and a bottom dead center.

Moreover, a slot 16 is formed in a main support member 107 and a cylinder 108, and a vane 11 is inserted into this slot 16 to reciprocate up and down. A back pressure chamber 17 is formed in a lower part of the slot 16, and a coil spring 18 is arranged as urging means in the slot 16 to urge the lower surface of the vane 11 upward. Moreover, the vane 11 abuts on the lower surface 113 of the compression member 109, and partitions the compression space 21 in the cylinder 108 into a low pressure chamber and a high pressure chamber. The coil spring 18 always urges the vane 11 toward the lower surface 113.

Moreover, a value of a pressure of the back pressure chamber 17 as a sealed space is set to be higher than that of the pressure of the refrigerant sucked into a suction port 27 and lower than that of the pressure in the sealed container 1 as described above in the respective embodiments. When the back pressure chamber 17 is not allowed to communicate with the inside of the sealed container 1, and formed into the sealed space, the refrigerant on low and high pressure chamber sides of the compression space 21 only slightly flows from a gap of the vane 11 into the back pressure chamber 17. Therefore, the back pressure chamber 17 has an intermediate pressure which is higher than the pressure of the refrigerant sucked into the suction port 27 and which is lower than the pressure in the sealed container 1. Accordingly, since the pressure in the back pressure chamber 17 is lower than that in the sealed container 1, the oil rises through an oil passage 42 in a rotary shaft 5 utilizing the pressure difference. The oil can be supplied from oil holes 44, 45 into a peripheral portion of the vane 11.

On the other hand, a space 115 on the other surface side of the compression member 109 is formed into the space sealed by the compression member 109 and the main support member 107. Accordingly, since the refrigerant slightly flows from the compression space 21 through the clearance between the compression member 109 and the cylinder 108, the space 115 has an intermediate pressure which is higher than the pressure of a low-pressure refrigerant sucked into the suction port 27 and which is lower than the pressure of a high-pressure refrigerant in the sealed container 1.

When the pressure of the space 115 is set to the intermediate pressure in this manner, it is possible to avoid a disadvantage that the compression member 109 is strongly pressed upward by the pressure of the space 115 and that the lower surface 113 of the compression member 109 as a receiving surface and the upper surface 112A of the projection part 112 are remarkably worn. Consequently, the durability of the lower surface 113 of the compression member 109 can be improved.

Furthermore, when the pressure of the space 115 on the other surface side of the compression member 109 is set to the intermediate pressure, the pressure of the space 115 is lower than that in the sealed container 1. Therefore, it is possible to supply the oil smoothly to the compression member 109 which is a peripheral portion of the space 115, or the vicinity of the main bearing 13 utilizing the pressure difference.

It is to be noted that even in the present embodiment, in the same manner as in the above-described embodiments, the back pressure chamber 17 is formed into the sealed space, and the pressure of the back pressure chamber 17 applied as the back pressure of the vane 11 is set to a value which is higher than that of the pressure of the refrigerant sucked into the suction port 27 and which is lower than that of the pressure in the sealed container 1. The present invention is not limited to a case where the back pressure chamber 17 is formed into the sealed space in this manner. For example, the back pressure chamber 17 may communicate with the inside of the sealed container 1 via a small passage (nozzle). In this case, since the refrigerant flows from the sealed container 1 through the nozzle into the back pressure chamber 17, the pressure of the refrigerant drops while the refrigerant passes through the nozzle. Accordingly, the back pressure chamber 17 has a value which is higher than that of the pressure of the refrigerant sucked into the suction port 27 and which is lower than that of the pressure in the sealed container 1. Therefore, the oil can be smoothly supplied to the peripheral portion of the vane 11 utilizing the pressure difference. When a diameter of the nozzle is adjusted, the pressure of the refrigerant flowing into the back pressure chamber 17 can be freely set.

Moreover, in the same manner as in the back pressure chamber 17, the space 115 as the sealed space on the other surface side of the compression member 109 has an intermediate pressure which is higher than the pressure of the low-pressure refrigerant sucked into the suction port 27 and which is lower than the pressure of the high-pressure refrigerant in the sealed container 1. However, the space 115 may be allowed to communicate with the inside of the sealed container 1 via the small passage (nozzle). In this case, since the refrigerant flows from the sealed container 1 through the nozzle into the space 115, the pressure of the refrigerant drops while the refrigerant passes through the nozzle. Accordingly, the space 115 indicates a value which is higher than that of the pressure of the refrigerant sucked into the suction port 27 and which is lower than that of the pressure in the sealed container 1. Therefore, it is possible to avoid a disadvantage that the lower surface 113 of the compression member 109 which is the receiving surface, and the upper surface 112A of the projected part 112 are remarkably worn. Consequently, the durability of the lower surface 113 of the compression member 109 can be improved. Furthermore, when the space 115 is set to such intermediate pressure, it is possible to supply the oil smoothly to the compression member 109 which is the peripheral portion of the space 115, or the vicinity of the main bearing 13 utilizing the pressure difference. When the diameter of the nozzle is adjusted, the pressure of the refrigerant flowing into the space 115 can be freely set.

It is to be noted that in the above-described embodiments, there has been described examples of the compressor which is used in the refrigerant circuit of the refrigerator and which compresses the refrigerant, but the present invention is not limited to the embodiments. The present invention is effective even when applied to a so-called air compressor for sucking, compressing, and discharging air.

What is claimed is:

1. A compressor comprising a driving element stored in a sealed container, and a compression element driven by a rotary shaft of the driving element, the compression element comprising:

a cylinder in which a compression space is constituted;

a suction port and a discharge port which communicate with the compression space in the cylinder;

a compression member whose one surface crossing an axial direction of the rotary shaft is inclined continuously between a top dead center and a bottom dead center and which is retractably disposed in the cylinder and which compresses a fluid sucked from the suction port to discharge the fluid from the discharge port; and a vane which is disposed between the suction port and the discharge port to abut on one surface of the compression member and which partitions the compression space in the cylinder into a low pressure chamber and a high pressure chamber, wherein one surface of the compression member is disposed on a side opposite to the driving element, wherein the compression element is disposed above the driving element, an oil pump for supplying oil to the compression element from an oil reservoir in a bottom part of the sealed container, wherein the fluid is discharged from the discharge port into the sealed container, and a back pressure of the vane is set to a value which is higher than that of a pressure of the fluid sucked into the suction port and which is lower than that of a pressure in the sealed container.

* * * * *